US012781396B2

(12) United States Patent
Song

(10) Patent No.: US 12,781,396 B2
(45) Date of Patent: Nov. 3, 2026

(54) DEVICE AND PROCESS FOR MANUFACTURING NATURAL FIBER FILLING MATERIAL

(71) Applicant: NALEXIBLE(BEIJING)TECHNOLOGY CO., LTD, Beijing (CN)

(72) Inventor: Zhibin Song, Beijing (CN)

( * ) Notice: Subject to any disclaimer, the term of this patent is extended or adjusted under 35 U.S.C. 154(b) by 163 days.

(21) Appl. No.: 18/671,987

(22) Filed: May 22, 2024

(65) Prior Publication Data

US 2025/0043469 A1 Feb. 6, 2025

(30) Foreign Application Priority Data

Aug. 4, 2023 (CN) ..... 202310978556.7

(51) Int. Cl.

| | |
|---|---|
| ***B30B 9/04*** | (2006.01) |
| ***B27N 3/20*** | (2006.01) |
| ***D03D 15/217*** | (2021.01) |
| ***D03D 15/283*** | (2021.01) |
| ***D03D 15/47*** | (2021.01) |
| ***D03D 23/00*** | (2006.01) |
| ***D03D 25/00*** | (2006.01) |

(52) U.S. Cl.

CPC ..... *D03D 15/217* (2021.01); *D03D 15/283* (2021.01); *D03D 15/47* (2021.01); *D03D 23/00* (2013.01); *D03D 25/005* (2013.01); *D10B 2201/01* (2013.01); *D10B 2321/022* (2013.01); *D10B 2403/033* (2013.01)

(58) Field of Classification Search

CPC ..... B30B 9/04; B30B 15/064; B30B 15/0088; B30B 11/02; B30B 1/36; B30B 1/32; B27N 3/203; B27N 3/20; B27N 3/16; B27N 3/143; B27N 3/10; B27N 3/06

See application file for complete search history.

(56) References Cited

U.S. PATENT DOCUMENTS

| | | | | | |
|---|---|---|---|---|---|
| 1,476,570 | A | * | 12/1923 | Adams | B27N 3/06 156/313 |
| 1,873,827 | A | * | 8/1932 | Durham | C09J 189/005 106/151.1 |
| 1,875,055 | A | * | 8/1932 | Loetscher | B27D 1/00 156/278 |
| 1,937,169 | A | * | 11/1933 | Robinson | H05B 3/00 100/324 |
| 2,172,003 | A | * | 9/1939 | Stanley | B27D 3/02 100/259 |
| 2,191,070 | A | * | 2/1940 | Cone | B27D 1/04 156/265 |

(Continued)

*Primary Examiner* — Matthew J Daniels
(74) *Attorney, Agent, or Firm* — Sandy Lipkin

(57) ABSTRACT

Disclosed in the present invention is a device for manufacturing a natural fiber filling material, which includes a ground, a mixed fiber felt preparation machine, an open-type oil heating mold, a hydraulic press, a single-sided roller gluing machine, a cold press, a lower mold, a hydraulic cylinder, an upper mold, a control box, a heat dissipation mechanism and a lubricating mechanism. The present invention relates to a device for manufacturing a natural fiber filling material. The device has a function of quickly dissipating heat from the control box on the cold press and can lubricate the hydraulic cylinder on the cold press.

7 Claims, 8 Drawing Sheets

(56) References Cited

U.S. PATENT DOCUMENTS 2,456,006 A * 12/1948 Hickler ..... B27D 1/04 428/528
2,830,924 A * 4/1958 Witt ..... B27N 3/06 156/278
2,881,731 A * 4/1959 Black ..... B05C 1/0834 118/227
2,990,872 A * 7/1961 Gaby ..... B27D 3/00 100/211
3,173,976 A * 3/1965 Paerels ..... D21J 1/00 264/109
3,331,411 A * 7/1967 Cecchi ..... B27D 3/02 100/196
3,383,735 A * 5/1968 Paerels ..... B27N 3/203 264/109
3,397,424 A * 8/1968 Rovde ..... B27N 3/22 425/422
3,518,724 A * 7/1970 Book ..... B27N 3/20 100/200
3,534,439 A * 10/1970 Weinberg ..... B27N 3/20 425/441
3,545,044 A * 12/1970 Morrison ..... B30B 15/026 425/398
3,594,867 A * 7/1971 Pfeiffer ..... B27N 3/203 83/699.61
3,695,225 A * 10/1972 Pape ..... B27G 11/00 118/227
3,785,279 A * 1/1974 Fails ..... B30B 7/02 156/359
3,895,984 A * 7/1975 Cone ..... B05D 7/08 156/290
4,082,828 A * 4/1978 Zulli ..... B27N 3/10 264/109
4,288,208 A * 9/1981 Kusters ..... B27N 3/16 425/371
4,504,207 A * 3/1985 Arnold ..... B30B 1/32 425/385
4,675,066 A * 6/1987 Honda ..... B27D 3/00 100/324
5,245,154 A * 9/1993 Sato ..... H05B 6/62 219/777
5,628,868 A * 5/1997 Marschke ..... B05C 1/0817 156/578
6,579,483 B1 * 6/2003 Vaders ..... B27N 3/08 264/293
2018/0036965 A1 * 2/2018 Segerstrom ..... B27N 3/00
2019/0126521 A1 * 5/2019 Yasuda ..... B29C 33/02
2024/0130493 A1 * 4/2024 Roosen ..... A45C 5/02

* cited by examiner

DEVICE AND PROCESS FOR MANUFACTURING NATURAL FIBER FILLING MATERIAL

FIELD OF TECHNOLOGY

The present invention belongs to the technical field of plates, and in particular to a device and a process for manufacturing a natural fiber filling material.

BACKGROUND

As is well known, plates are made into standard size flat rectangular material boards, which are used for components of walls, ceilings or floors in the construction industry. The plates also refer metal plates formed by forging, rolling or casting, and also include wood lumber, furniture panels, construction panels, engineering formwork, wood board materials, etc. A device for manufacturing a natural fiber filling material is often used in the manufacture of the plates.

However, the existing devices for making the natural fiber filling materials still have some shortcomings in use. Firstly, the existing devices for manufacturing the natural fiber filling materials simply use natural ventilation to dissipate heat of a control box on a hydraulic press, which leads to the problem of poor heat dissipation efficiency of the control box due to a weak heat dissipation effect of natural ventilation.

Secondly, the existing devices for making the natural fiber filling materials mostly use the hydraulic press to press mixed fiber felt, due to the influence of material friction between a cylinder body and a telescopic rod, the problem of large telescopic resistance of the hydraulic cylinder will be caused after long-term use.

SUMMARY

A purpose of the present invention is to provide a device and a process for manufacturing a natural fiber filling material in order to solve the above problems, and to solve the problems mentioned in the background above.

In order to solve the above problems, the present invention provides a technical solution as follows.

A device for manufacturing a natural fiber filling material includes a ground, a mixed fiber felt preparation machine, an open-type oil heating mold, a hydraulic press, a single-sided roller gluing machine, a cold press, a lower mold, a hydraulic cylinder, an upper mold, a control box, a heat dissipation mechanism and a lubricating mechanism, where the mixed fiber felt preparation machine is disposed on the ground, the open-type oil heating mold is disposed on the ground, the hydraulic press is disposed on the ground, the single-sided roller gluing machine is disposed on the ground, the cold press is disposed on the ground, the hydraulic press is provided with the lower mold, the hydraulic cylinder is disposed on the hydraulic press, a telescopic end of the hydraulic cylinder is slidably connected with the hydraulic press, the telescopic end of the hydraulic cylinder is fixedly connected with the upper mold, the hydraulic press is provided with the control box, the control box is provided with the heat dissipation mechanism, and the hydraulic press is provided with the lubricating mechanism.

Preferably, the heat dissipation mechanism includes ventilation holes, an air inlet hole, a mounting housing, a semiconductor refrigeration sheet, a motor I, a bevel gear I, fan blades, a mounting disk, a filter screen, a mounting rod, a rotating shaft, a bevel gear II, ejection plates, a scraper and an elastic air bag, the ventilation holes are formed in the control box, the air inlet hole is formed in the control box, the control box is fixedly connected with the mounting housing, the semiconductor refrigeration sheet is fixedly mounted in the mounting housing, a cold end of the semiconductor refrigeration sheet is located inside the mounting housing, a hot end of the semiconductor refrigeration sheet is located outside the mounting housing, the motor I is fixedly mounted in the mounting housing, an outer side of an output end of the motor I is fixedly sleeved with the bevel gear I, the output end of the motor I is fixedly connected with the fan blades, the mounting disk is fixedly connected in the mounting housing, the filter screen is fixedly connected in the mounting disk, the mounting rod is fixedly connected in the mounting housing, the rotating shaft is mounted in the mounting rod through a bearing, the rotating shaft is rotatably connected with the mounting disk, the ejection plates are slidably connected in the rotating shaft, the ejection plates are fixedly connected with the scraper, and the scraper is slidably connected with the filter screen and the mounting disk; through the arrangement of the fan blades, when the fan blades are forced to rotate, air can be blown to flow rapidly; the mounting disk is fixedly connected in the mounting housing, the filter screen is fixedly connected in the mounting disk, the mounting rod is fixedly connected in the mounting housing, the rotating shaft is mounted in the mounting rod through a bearing, the rotating shaft is rotatably connected with the mounting disk; an outer side of the rotating shaft is fixedly sleeved with the bevel gear II, and the bevel gear II is meshed with the bevel gear I; through a meshing relationship, the bevel gear II can be driven to rotate when the bevel gear I is forced to rotate; the ejection plates are slidably connected in the rotating shaft, the ejection plates are fixedly connected with the scraper, and the scraper is slidably connected with the filter screen and the mounting disk; the elastic air bag is bonded to the scraper, the other end of the elastic air bag is bonded to the rotating shaft, and through the arrangement of the elastic air bag, the scraper can be connected and used; through the arrangement of the semiconductor refrigeration sheet, the air can be refrigerated; the motor I is started to drive the output end to rotate, so as to drive the fan blades to rotate and blow the air, for the purpose of accelerating circulation of cold air and improving a heat dissipation effect of the control box; dust in the air can be filtered out under the action of the filter screen; the bevel gear I can be driven to rotate when the motor I drives the output end to rotate; under a meshing relationship, the bevel gear I is forced to drive the bevel gear II to rotate, further to drive the rotating shaft to rotate, further to cause the ejection plates to drive the scraper to slide along a surface of the filter screen, so as to clean the dust attached to the filter screen and avoid the blockage of the filter screen; and when the scraper is worn and thinned after long-time use, under the deformation of the elastic air bag, the scraper can be pushed to be in contact with the filter screen to ensure a cleaning effect of the scraper.

Preferably, an outer side of the rotating shaft is fixedly sleeved with the bevel gear II, the bevel gear II is meshed with the bevel gear I, and through a meshing relationship, the bevel gear II can be driven to rotate when the bevel gear I is forced to rotate.

Preferably, the elastic air bag is bonded to the scraper, the other end of the elastic air bag is bonded to the rotating shaft, and through the arrangement of the elastic air bag, the scraper can be connected and used.

Preferably, a plurality of fan blades are provided, and the plurality of fan blades are arranged in an annular array on the output end of the motor I, and through the arrangement of the fan blades, when the fan blades are forced to rotate, air can be blown to flow rapidly.

Preferably, the lubricating mechanism includes a flow guide pipe, an oil storage barrel, a sealing ball, a supporting shaft, a rotating end, a belt pulley I, a mounting plate, a motor II, a belt pulley II, a belt, clamping holes, an elastic block and a clamping ball, the flow guide pipe is fixedly connected in the hydraulic press, the hydraulic press is fixedly connected with the oil storage barrel, the sealing ball is rotatably connected in the oil storage barrel, the supporting shaft is fixedly connected with the sealing ball, the supporting shaft is rotatably connected with the oil storage barrel, the rotating end is fixedly connected with the sealing ball, the rotating end is rotatably connected with the oil storage barrel, an outer side of the rotating end is fixedly sleeved with the belt pulley I, the mounting plate is fixedly connected in the oil storage barrel, the motor II is fixedly mounted on the mounting plate, an output shaft of the motor II is rotatably connected with the mounting plate, an outer side of the output shaft of the motor II is fixedly sleeved with the belt pulley II, the belt pulley II and the belt pulley I are jointly sleeved with the belt, the clamping holes are formed in the output shaft of the motor II, the elastic block is bonded in the oil storage barrel, the clamping ball is bonded in the elastic block, and the clamping ball is slidably connected with the clamping hole; the motor II drives the output shaft to rotate, so as to drive the belt pulley II to rotate, and then drive the belt to drive, and finally drive the belt pulley I to rotate, the rotating end is driven to rotate by the belt pulley I under a force to drive the sealing ball to deflect, so that a through hole formed in the sealing ball rotates, and then the oil storage barrel is in a circulating state, wherein during this process, the clamping hole is forced to squeeze the clamping ball, the clamping ball is forced to push the elastic block to deform and finally the clamping ball is separated from the clamping hole, the clamping ball slides along a surface of the output shaft of the motor II under the action of force, when the clamping ball slides into the next clamping hole, the elastic block recovers deformation thereof to push the clamping ball into the clamping hole to limit the output shaft of the motor II, further o accurately control a rotation position of the sealing ball and finally cause lubricating oil to flow through the flow guide pipe into the hydraulic press, so that the lubricating oil is in contact with the telescopic end of the hydraulic cylinder to lubricate the hydraulic cylinder.

Preferably, a plurality of clamping holes are provided, the plurality of clamping holes are arranged in an annular array on the output shaft of the motor II, and through the arrangement of the clamping holes, the clamping ball can be matched with the clamping hole by clamping for use.

A use method of the device for manufacturing the natural fiber filling material include the following specific steps:

step one: preparing wood fiber, hemp fiber and polypropylene fiber into filaments, wherein a mass ratio of wood fiber to hemp fiber to polypropylene fiber is (1-3):(3-5):(3-5); under the action of the mixed fiber felt preparation machine, opening, premixing, mixing and separating, carding, crossing, lapping, pre-needling, finish-needling and cutting off the obtained filamentous fiber so as to be woven into mixed fiber felt, and putting the mixed fiber felt into the open-type oil heating mold and heating the mixed fiber felt in the open-type oil heating mold at a temperature of 200-240° C. for 1-2 minutes;

step two: then, taking out the mixed fiber felt in a soft state and putting the mixed fiber felt into the lower mold, keeping the mixed fiber felt in the mold under a pressure of 20-25 Mpa from the hydraulic press for 2-3 minutes, and taking out a molded natural fiber substrate;

step three: in this process, through the arrangement of the control box, possibly performing the following operations: controlling and using the hydraulic cylinder; in order to ensure that electronic elements in the control box operate at a normal temperature, starting the semiconductor refrigeration sheet to cool air; starting the motor I to drive the output end to rotate, so as to drive the fan blades to rotate and blow the air, for the purpose of accelerating circulation of cold air and improving a heat dissipation effect of the control box; filtering out dust in the air under the action of the filter screen; driving the bevel gear I to rotate when the motor I drives the output end to rotate; under a meshing relationship, allowing the bevel gear I to be forced to drive the bevel gear II to rotate, further to drive the rotating shaft to rotate, further to cause the ejection plates to drive the scraper to slide along a surface of the filter screen, so as to clean the dust attached to the filter screen and avoid the blockage of the filter screen; and when the scraper is worn and thinned after long-time use, pushing, under the deformation of the elastic air bag, the scraper to be in contact with the filter screen to ensure a cleaning effect of the scraper;

step four: starting the motor II to drive the output shaft to rotate, so as to drive the belt pulley II to rotate, and then drive the belt to drive, and finally drive the belt pulley I to rotate; driving the rotating end to rotate by the belt pulley I under a force to drive the sealing ball to deflect, so that a through hole formed in the sealing ball rotates, and then the oil storage barrel is in a circulating state, wherein during this process, the clamping hole is forced to squeeze the clamping ball, the clamping ball is forced to push the elastic block to deform and finally the clamping ball is separated from the clamping hole, the clamping ball slides along a surface of the output shaft of the motor II under the action of force, when the clamping ball slides into the next clamping hole, the elastic block recovers deformation thereof to push the clamping ball into the clamping hole to limit the output shaft of the motor II, to accurately control a rotation position of the sealing ball and finally cause lubricating oil to flow through the flow guide pipe into the hydraulic press, so that the lubricating oil is in contact with the telescopic end of the hydraulic cylinder to lubricate the hydraulic cylinder; and step five: then putting the natural fiber substrate into the open-type oil heating mold again, taking out the mixed fiber felt in the soft state and putting the mixed fiber felt into the lower mold, keeping the mixed fiber felt in the lower mold under a pressure of 315-500 T from the hydraulic press for 8-10 seconds, taking out a molded natural fiber core material for later use, passing two plate sheets through the single-sided roller gluing machine for gluing for later use, putting the core material between the two plate sheets, putting the core material and the two plate sheets in the cold press for laminating for 1-2 minutes, and taking out a molded natural fiber plate.

The present invention has the beneficial effects that the present invention relates to the device for manufacturing the natural fiber filling material, and the device has the function of quickly dissipating heat from the control box on the cold press and can lubricate the hydraulic cylinder on the cold press and has the following beneficial effects in specific use.

Firstly, through the arrangement of the heat dissipation mechanism, the ventilation holes, the air inlet hole, the mounting housing, the semiconductor refrigeration sheet, the motor I, the bevel gear I, the fan blades, the mounting disk, the filter screen and other structures, and through the arrangement of the semiconductor refrigeration sheet, the air can be refrigerated; under the action of the motor I, and the bevel gear I and other structures, the fan blades can be driven to rotate and blow the cold air for accelerating circulation of cold air and dissipating heat of the control box; dust in the air can be filtered out in cooperation with the filter screen; and through the cooperation of the ejection plates, the elastic air bag and other structures, the scraper can be pushed to clean the filter screen, thus avoiding the blockage of the filter screen.

Secondly, through the arrangement of the lubricating mechanism, the flow guide pipe, the oil storage barrel, the sealing ball, the supporting shaft, the rotating end, the belt pulley I, the mounting plate, the motor II, the belt pulley II, the belt and other structures, and through the arrangement of the motor II, the belt pulley II, the belt and other structures, the sealing ball can be driven to rotate, and then the oil storage barrel is opened, so that the lubricating oil is in a circulating state, to complete a lubrication operation on the hydraulic cylinder; and in cooperation with the clamping holes, the clamping ball and other structures, the output shaft of the motor II can be limited, and the position of the sealing ball can be accurately controlled and used.

BRIEF DESCRIPTION OF THE DRAWINGS

For ease of illustration, the present invention is described in detail by the following detailed description and the accompanying drawings.

Figure 1:
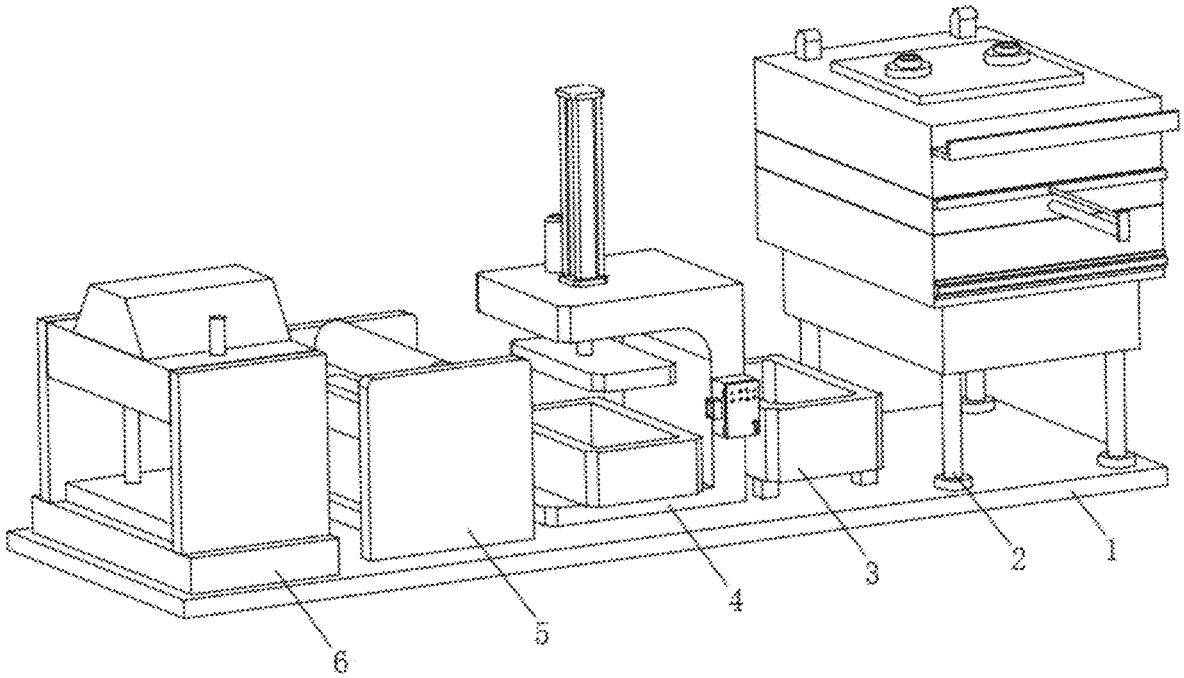
FIG. 1 is a perspective view of an overall structure according to the present invention.

In the drawings: 1. ground; 2. mixed fiber felt preparation machine; 3. open-type oil heating mold; 4. hydraulic press; 5. single-sided roller gluing machine; 6. cold press; 7. lower mold; 8. hydraulic cylinder; 9. upper mold; 10. control box; 11. heat dissipation mechanism; 12. lubricating mechanism; 111. ventilation hole; 112. air inlet hole; 113. mounting housing; 114. semiconductor refrigeration sheet; 115. motor I; 116. bevel gear I; 117. fan blade; 118. mounting disk; 119. filter screen; 1191. mounting rod; 1192. rotating shaft; 11921. bevel gear II; 1193. ejection plate; 1194. scraper; 1195. elastic air bag; 121. flow guide pipe; 122. oil storage barrel; 123. sealing ball; 124. supporting shaft; 125. rotating end; 126. belt pulley I; 127. mounting plate; 128. motor II; 129. belt pulley II; 1291. belt; 1292. clamping hole; 1293. elastic block; 1294. clamping ball.

DETAILED DESCRIPTION

Figure 2:
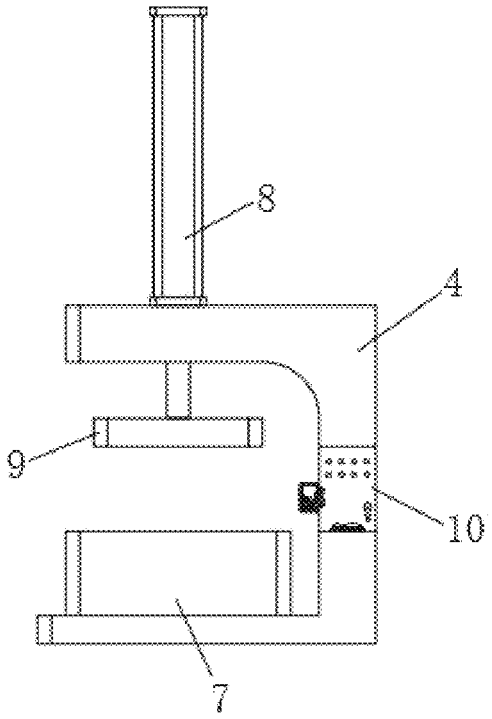
FIG. 2 is a front sectional view of a hydraulic press of FIG. 1 according to the present invention.
Figure 3:
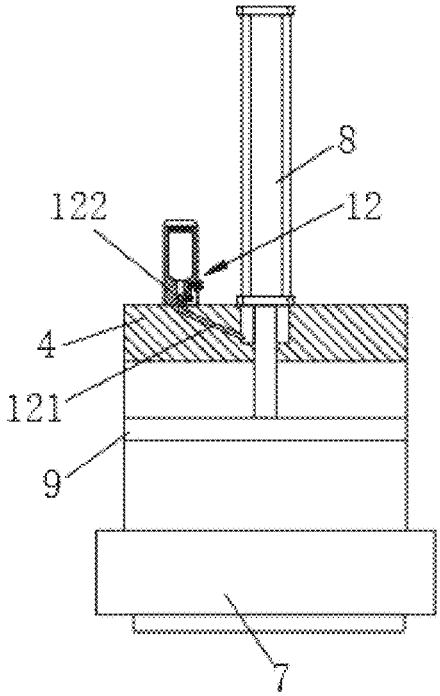
FIG. 3 is a side sectional view of the hydraulic press of FIG. 1 according to the present invention.
Figure 4:
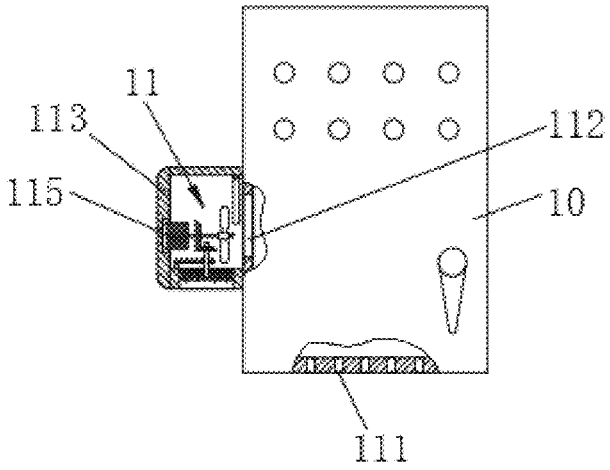
FIG. 4 is an enlarged view of a control box of FIG. 2 according to the present invention.
Figure 5:
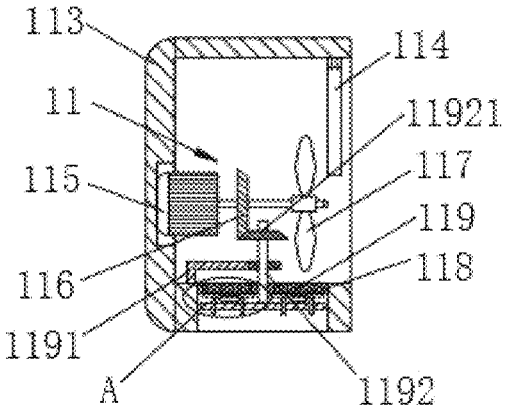
FIG. 5 is a partial enlarged view of a heat dissipation mechanism of FIG. 4 according to the present invention.
Figure 6:
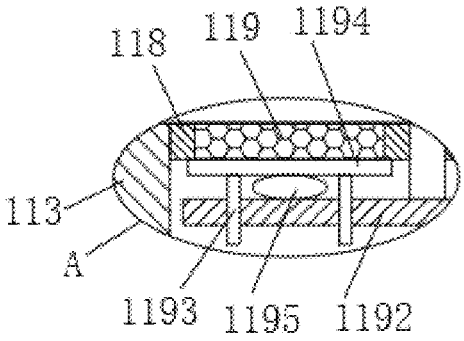
FIG. 6 is an enlarged view at a part A of FIG. 5 according to the present invention.
Figure 7:
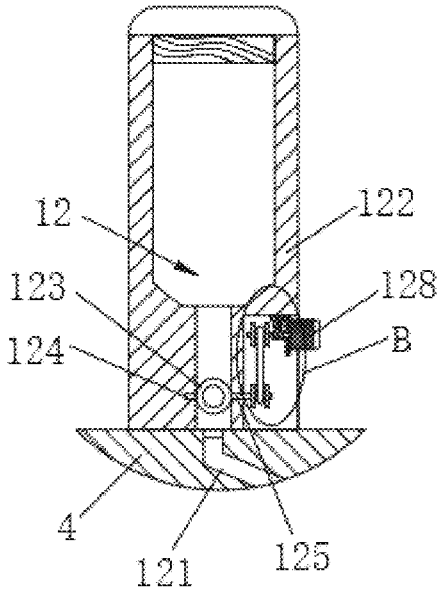
FIG. 7 is an enlarged view of a lubricating mechanism of FIG. 3 according to the present invention.
Figure 8:
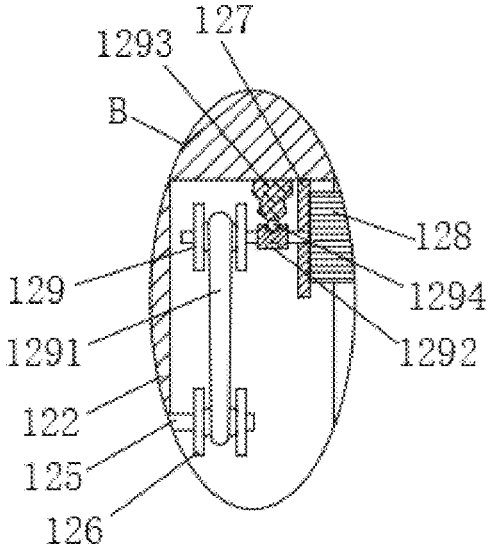
FIG. 8 is an enlarged view at a part B of FIG. 7 according to the present invention.

As shown in FIGS. 1-8, this detailed description adopts the following technical solution.

Example

A device for manufacturing a natural fiber filling material includes a ground 1, a mixed fiber felt preparation machine 2, an open-type oil heating mold 3, a hydraulic press 4, a single-sided roller gluing machine 5, a cold press 6, a lower mold 7, a hydraulic cylinder 8, an upper mold 9, a control box 10, a heat dissipation mechanism 11 and a lubricating mechanism 12, where the mixed fiber felt preparation machine 2 is disposed on the ground 1, the open-type oil heating mold 3 is disposed on the ground 1, the hydraulic press 4 is disposed on the ground 1, the single-sided roller gluing machine 5 is disposed on the ground 1, the cold press 6 is disposed on the ground 1, the hydraulic press 4 is provided with the lower mold 7, the hydraulic cylinder 8 is disposed on the hydraulic press 4, a telescopic end of the hydraulic cylinder 8 is slidably connected with the hydraulic press 4, the telescopic end of the hydraulic cylinder 8 is fixedly connected with the upper mold 9, and the hydraulic press 4 is provided with the control box 10.

The control box 10 is provided with the heat dissipation mechanism 11, the heat dissipation mechanism 11 includes ventilation holes 111, an air inlet hole 112, a mounting housing 113, a semiconductor refrigeration sheet 114, a motor I 115, a bevel gear I 116, fan blades 117, a mounting disk 118, a filter screen 119, a mounting rod 1191, a rotating shaft 1192, a bevel gear II 11921, ejection plates 1193, a scraper 1194 and an elastic air bag 1195, the ventilation holes 111 are formed in the control box 10, the air inlet hole 112 is formed in the control box 10, the control box 10 is fixedly connected with the mounting housing 113, the semiconductor refrigeration sheet 114 is fixedly mounted in the mounting housing 113, a cold end of the semiconductor refrigeration sheet 114 is located inside the mounting housing 113, a hot end of the semiconductor refrigeration sheet 114 is located outside the mounting housing 113, the motor I 115 is fixedly mounted in the mounting housing 113, an outer side of an output end of the motor I 115 is fixedly sleeved with the bevel gear I 116, the output end of the motor I 115 is fixedly connected with the fan blades 117, the plurality of fan blades 117 are provided, and the plurality of fan blades 117 are arranged in an annular array on the output end of the motor I 115; through the arrangement of the fan blades 117, when the fan blades 117 are forced to rotate, air can be blown to flow rapidly; the mounting disk 118 is fixedly connected in the mounting housing 113, the filter screen 119 is fixedly connected in the mounting disk 118, the mounting rod 1191 is fixedly connected in the mounting housing 113, the rotating shaft 1192 is mounted in the mounting rod 1191 through a bearing, the rotating shaft 1192 is rotatably connected with the mounting disk 118; an outer side of the rotating shaft 1192 is fixedly sleeved with the bevel gear II 11921, and the bevel gear II 11921 is meshed with the bevel gear I 116; through a meshing relationship, the bevel gear II 11921 can be driven to rotate when the bevel gear I 116 is forced to rotate; the ejection plates 1193 are slidably connected in the rotating shaft 1192, the ejection plates 1193 are fixedly connected with the scraper 1194, and the scraper 1194 is slidably connected with the filter screen 119 and the mounting disk 118; the elastic air bag 1195 is bonded to the scraper 1194, the other end of the elastic air bag 1195 is bonded to the rotating shaft 1192, and through the arrangement of the elastic air bag 1195, the scraper 1194 can be connected and used; through the arrangement of the semiconductor refrigeration sheet 114, the air can be refrigerated; the motor I 115 is started to drive the output end to rotate, so as to drive the fan blades 117 to rotate and blow the air, for the purpose of accelerating circulation of cold air and improving a heat dissipation effect of the control box 10; dust in the air can be filtered out under the action of the filter screen 119; the bevel gear I 116 can be driven to rotate when the motor I 115 drives the output end to rotate; under a meshing relationship, the bevel gear I 116 is forced to drive the bevel gear II 11921 to rotate, further to drive the rotating shaft 1192 to rotate, further to cause the ejection plates 1193 to drive the scraper 1194 to slide along a surface of the filter screen 119, so as to clean the dust attached to the filter screen 119 and avoid the blockage of the filter screen 119; and when the scraper 1194 is worn and thinned after long-time use, under the deformation of the elastic air bag 1195, the scraper 1194 can be pushed to be in contact with the filter screen 119 to ensure a cleaning effect of the scraper 1194.

The hydraulic press 4 is provided with the lubricating mechanism 12; the lubricating mechanism 12 includes a flow guide pipe 121, an oil storage barrel 122, a sealing ball 123, a supporting shaft 124, a rotating end 125, a belt pulley I 126, a mounting plate 127, a motor II 128, a belt pulley II 129, a belt 1291, clamping holes 1292, an elastic block 1293 and a clamping ball 1294, the flow guide pipe 121 is fixedly connected in the hydraulic press 4, the hydraulic press 4 is fixedly connected with the oil storage barrel 122, the sealing ball 123 is rotatably connected in the oil storage barrel 122, the supporting shaft 124 is fixedly connected with the sealing ball 123, the supporting shaft 124 is rotatably connected with the oil storage barrel 122, the rotating end 125 is fixedly connected with the sealing ball 123, the rotating end 125 is rotatably connected with the oil storage barrel 122, an outer side of the rotating end 125 is fixedly sleeved with the belt pulley I 126, the mounting plate 127 is fixedly connected in the oil storage barrel 122, the motor II 128 is fixedly mounted on the mounting plate 127, an output shaft of the motor II 128 is rotatably connected with the mounting plate 127, an outer side of the output shaft of the motor II 128 is fixedly sleeved with the belt pulley II 129, the belt pulley II 129 and the belt pulley I 126 are jointly sleeved with the belt 1291; the clamping holes 1292 are formed in the output shaft of the motor II 128; a plurality of clamping holes 1292 are provided, the plurality of clamping holes 1292 are arranged in an annular array on the output shaft of the motor II 128, and through the arrangement of the clamping holes 1292, the clamping ball 1294 can be matched with the clamping hole by clamping for use; the elastic block 1293 is bonded in the oil storage barrel 122, the clamping ball 1294 is bonded in the elastic block 1293, and the clamping ball 1294 is slidably connected with the clamping hole 1292; the motor II 128 drives the output shaft to rotate, so as to drive the belt pulley II 129 to rotate, and then drive the belt 1291 to drive, and finally drive the belt pulley I 126 to rotate, the rotating end 125 is driven to rotate by the belt pulley I 126 under a force to drive the sealing ball 123 to deflect, so that a through hole formed in the sealing ball 123 rotates, and then the oil storage barrel 122 is in a circulating state, wherein during this process, the clamping hole 1292 is forced to squeeze the clamping ball 1294, the clamping ball 1294 is forced to push the elastic block 1293 to deform and finally the clamping ball 1294 is separated from the clamping hole 1292, the clamping ball 1294 slides along a surface of the output shaft of the motor II 128 under the action of force, when the clamping ball 1294 slides into the next clamping hole 1292, the elastic block 1293 recovers deformation thereof to push the clamping ball 1294 into the clamping hole 1292 to limit the output shaft of the motor II 128, further o accurately control a rotation position of the sealing ball 123 and finally cause lubricating oil to flow through the flow guide pipe 121 into the hydraulic press 4, so that the lubricating oil is in contact with the telescopic end of the hydraulic cylinder 8 to lubricate the hydraulic cylinder 8; and A use method of the device for manufacturing the natural fiber filling material include the following specific steps:

step one: preparing wood fiber, hemp fiber and polypropylene fiber into filaments, wherein a mass ratio of wood fiber to hemp fiber to polypropylene fiber is 2:4:4; under the action of the mixed fiber felt preparation machine 2, opening, premixing, mixing and separating, carding, crossing, lapping, pre-needling, finish-needling and cutting off the obtained filamentous fiber so as to be woven into mixed fiber felt, and putting the mixed fiber felt into the open-type oil heating mold 3 and heating the mixed fiber felt in the open-type oil heating mold 3 at a temperature of 220° C. for 1.5 minutes;

step two: then, taking out the mixed fiber felt in a soft state and putting the mixed fiber felt into the lower mold 7, keeping the mixed fiber felt in the mold under a pressure of 22 Mpa from the hydraulic press 4 for 2.5 minutes, and taking out a molded natural fiber substrate;

step three: in this process, through the arrangement of the control box 10, possibly performing the following operations: controlling and using the hydraulic cylinder 8; in order to ensure that electronic elements in the control box 10 operate at a normal temperature, starting the semiconductor refrigeration sheet 114 to cool air; starting the motor I 115 to drive the output end to rotate, so as to drive the fan blades 117 to rotate and blow the air, for the purpose of accelerating circulation of cold air and improving a heat dissipation effect of the control box 10; filtering out dust in the air under the action of the filter screen 119; driving the bevel gear I 116 to rotate when the motor I 115 drives the output end to rotate; under a meshing relationship, allowing the bevel gear I 116 to be forced to drive the bevel gear II 11921 to rotate, further to drive the rotating shaft 1192 to rotate, further to cause the ejection plates 1193 to drive the scraper 1194 to slide along a surface of the filter screen 119, so as to clean the dust attached to the filter screen 119 and avoid the blockage of the filter screen 119; and when the scraper 1194 is worn and thinned after long-time use, pushing, under the deformation of the elastic air bag 1195, the scraper 1194 to be in contact with the filter screen 119 to ensure a cleaning effect of the scraper 1194;

step four: starting the motor II 128 to drive the output shaft to rotate, so as to drive the belt pulley II 129 to rotate, and then drive the belt 1291 to drive, and finally drive the belt pulley I 126 to rotate; driving the rotating end 125 to rotate by the belt pulley I 126 under a force to drive the sealing ball 123 to deflect, so that a through hole formed in the sealing ball 123 rotates, and then the oil storage barrel 122 is in a circulating state, wherein during this process, the clamping hole 1292 is forced to squeeze the clamping ball 1294, the clamping ball 1294 is forced to push the elastic block 1293 to deform and finally the clamping ball 1294 is separated from the clamping hole 1292, the clamping ball 1294 slides along a surface of the output shaft of the motor II 128 under the action of force, when the clamping ball 1294 slides into the next clamping hole 1292, the elastic block 1293 recovers deformation thereof to push the clamping ball 1294 into the clamping hole 1292 to limit the output shaft of the motor II 128, to accurately control a rotation position of the sealing ball 123 and finally cause lubricating oil to flow through the flow guide pipe 121 into the hydraulic press 4, so that the lubricating oil is in contact with the telescopic end of the hydraulic cylinder 8 to lubricate the hydraulic cylinder 8; and step five: then putting the natural fiber substrate into the open-type oil heating mold 3 again, taking out the mixed fiber felt in the soft state and putting the mixed fiber felt into the lower mold 7, keeping the mixed fiber felt in the lower mold 7 under a pressure of 400 T from the hydraulic press 4 for 9 seconds, taking out a molded natural fiber core material for later use, passing two plate sheets (density boards, particleboards, composite boards, oriented strand boards, Ousson pine boards, etc.) through the single-sided roller gluing machine 5 for gluing for later use, putting the core material between the two plate sheets, putting the core material and the two plate sheets in the cold press 6 for laminating for 1.5 minutes, and taking out a molded natural fiber plate.

While the basic principles, main features and advantages of the present invention have been shown and described above, it will be understood by those skilled in the art that the present invention is not limited by the foregoing embodiments, and the foregoing embodiments and description have been provided merely to illustrate the principles of the present invention, and various changes and modifications may be made therein without departing from the spirit and scope of the present invention as defined by the appended claims and their equivalents.

What is claimed is:

1. A device for manufacturing a natural fiber filling material, comprising a ground (1), a mixed fiber felt preparation machine (2), an open-type oil heating mold (3), a hydraulic press (4), a single-sided roller gluing machine (5), a cold press (6), a lower mold (7), a hydraulic cylinder (8), an upper mold (9), a control box (10), a heat dissipation mechanism (11) and a lubricating mechanism (12), wherein the mixed fiber felt preparation machine (2) is disposed on the ground (1), the open-type oil heating mold (3) is disposed on the ground (1), the hydraulic press (4) is disposed on the ground (1), the single-sided roller gluing machine (5) is disposed on the ground (1), the cold press (6) is disposed on the ground (1), the hydraulic press (4) is provided with the lower mold (7), the hydraulic cylinder (8) is disposed on the hydraulic press (4), a telescopic end of the hydraulic cylinder (8) is slidably connected with the hydraulic press (4), the telescopic end of the hydraulic cylinder (8) is fixedly connected with the upper mold (9), the hydraulic press (4) is provided with the control box (10), the control box (10) is provided with the heat dissipation mechanism (11), and the hydraulic press (4) is provided with the lubricating mechanism (12).

2. The device for manufacturing the natural fiber filling material according to claim 1, wherein the heat dissipation mechanism (11) comprises ventilation holes (111), an air inlet hole (112), a mounting housing (113), a semiconductor refrigeration sheet (114), a motor I (115), a bevel gear I (116), fan blades (117), a mounting disk (118), a filter screen (119), a mounting rod (1191), a rotating shaft (1192), a bevel gear II (11921), ejection plates (1193), a scraper (1194) and an elastic air bag (1195), the ventilation holes (111) are formed in the control box (10), the air inlet hole (112) is formed in the control box (10), the control box (10) is fixedly connected with the mounting housing (113), the semiconductor refrigeration sheet (114) is fixedly mounted in the mounting housing (113), a cold end of the semiconductor refrigeration sheet (114) is located inside the mounting housing (113), a hot end of the semiconductor refrigeration sheet (114) is located outside the mounting housing (113), the motor I (115) is fixedly mounted in the mounting housing (113), an outer side of an output end of the motor I (115) is fixedly sleeved with the bevel gear I (116), the output end of the motor I (115) is fixedly connected with the fan blades (117), the mounting disk (118) is fixedly connected in the mounting housing (113), the filter screen (119) is fixedly connected in the mounting disk (118), the mounting rod (1191) is fixedly connected in the mounting housing (113), the rotating shaft (1192) is mounted in the mounting rod (1191) through a bearing, the rotating shaft (1192) is rotatably connected with the mounting disk (118), the ejection plates (1193) are slidably connected in the rotating shaft (1192), the ejection plates (1193) are fixedly connected with the scraper (1194), and the scraper (1194) is slidably connected with the filter screen (119) and the mounting disk (118).

3. The device for manufacturing the natural fiber filling material according to claim 2, wherein an outer side of the rotating shaft (1192) is fixedly sleeved with the bevel gear II (11921), and the bevel gear II (11921) is meshed with the bevel gear I (116).

4. The device for manufacturing the natural fiber filling material according to claim 2, wherein the elastic air bag (1195) is bonded to the scraper (1194), and the other end of the elastic air bag (1195) is bonded to the rotating shaft (1192).

5. The device for manufacturing the natural fiber filling material according to claim 2, wherein a plurality of fan blades (117) are provided, and the plurality of fan blades (117) are arranged in an annular array on the output end of the motor I (115).

6. The device for manufacturing the natural fiber filling material according to claim 1, wherein the lubricating mechanism (12) comprises a flow guide pipe (121), an oil storage barrel (122), a sealing ball (123), a supporting shaft (124), a rotating end (125), a belt pulley I (126), a mounting plate (127), a motor II (128), a belt pulley II (129), a belt (1291), clamping holes (1292), an elastic block (1293) and a clamping ball (1294), the flow guide pipe (121) is fixedly connected in the hydraulic press (4), the hydraulic press (4) is fixedly connected with the oil storage barrel (122), the sealing ball (123) is rotatably connected in the oil storage barrel (122), the supporting shaft (124) is fixedly connected with the sealing ball (123), the supporting shaft (124) is rotatably connected with the oil storage barrel (122), the rotating end (125) is fixedly connected with the sealing ball (123), the rotating end (125) is rotatably connected with the oil storage barrel (122), an outer side of the rotating end (125) is fixedly sleeved with the belt pulley I (126), the mounting plate (127) is fixedly connected in the oil storage barrel (122), the motor II (128) is fixedly mounted on the mounting plate (127), an output shaft of the motor II (128) is rotatably connected with the mounting plate (127), an outer side of the output shaft of the motor II (128) is fixedly sleeved with the belt pulley II (129), the belt pulley II (129) and the belt pulley I (126) are jointly sleeved with the belt (1291), the clamping holes (1292) are formed in the output shaft of the motor II (128), the elastic block (1293) is bonded in the oil storage barrel (122), the clamping ball (1294) is bonded in the elastic block (1293), and the clamping ball (1294) is slidably connected with the clamping hole (1292).

7. The device for manufacturing the natural fiber filling material according to claim 6, wherein a plurality of clamping holes (1292) are formed, and the plurality of clamping holes (1292) are arranged in an annular array on the output shaft of the motor II (128).

* * * * *